US012768343B2

(12) United States Patent
Urata et al.

(10) Patent No.: US 12,768,343 B2
(45) Date of Patent: Oct. 20, 2026

(54) BELLOWS PUMP DEVICE

(71) Applicant: NIPPON PILLAR PACKING CO., LTD., Osaka (JP)

(72) Inventors: Daisuke Urata, Osaka (JP); Katsuhiko Fukui, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 302 days.

(21) Appl. No.: 18/707,358

(22) PCT Filed: Aug. 31, 2022

(86) PCT No.: PCT/JP2022/032744

§ 371 (c)(1),
(2) Date: May 3, 2024

(87) PCT Pub. No.: WO2023/139832

PCT Pub. Date: Jul. 27, 2023

(65) Prior Publication Data

US 2026/0160241 A1 Jun. 11, 2026

(30) Foreign Application Priority Data

Jan. 20, 2022 (JP) ..... 2022-007180

(51) Int. Cl.
*F04B 45/02* (2006.01)
*F04B 11/00* (2006.01)
(Continued)

(52) U.S. Cl.
CPC ..... *F04B 45/022* (2013.01); *F04B 11/00* (2013.01); *F04B 43/084* (2013.01);
(Continued)

(58) Field of Classification Search
CPC ..... F04B 43/084–086; F04B 43/10; F04B 43/1136; F04B 45/022; F04B 45/033; F04B 49/08; F04B 49/12; F04B 11/00
See application file for complete search history.

(56) References Cited

U.S. PATENT DOCUMENTS 6,322,338 B1 * 11/2001 Nishio ..... F04B 11/0016 138/30
9,239,047 B2 * 1/2016 Iwabuchi ..... F04B 43/0009
(Continued)

FOREIGN PATENT DOCUMENTS

CN 102057160 A * 5/2011 ..... F04B 53/10
CN 103388577 A * 11/2013
(Continued)

OTHER PUBLICATIONS

International Search Report issued in corresponding International Application No. PCT/JP2022/032744 mailed Nov. 1, 2022 (2 pages).

*Primary Examiner* — Alexander B Comley
(74) *Attorney, Agent, or Firm* — Osha Bergman Watanabe & Burton LLP

(57) ABSTRACT

A bellows pump device includes a control unit configured to perform operation control of a first driving unit and a second driving unit on the basis of respective detection signals of a first detection unit and a second detection unit such that, after expansion drive of a first bellows (second bellows) is stopped in a first mid-expansion state (second mid-expansion state) before a most expanded state, contraction drive of the first bellows (second bellows) is started before the second bellows (first bellows) reaches a most contracted state.

3 Claims, 5 Drawing Sheets

(51) Int. Cl.

| | |
|---|---|
| ***F04B 43/08*** | (2006.01) |
| ***F04B 43/113*** | (2006.01) |
| *F04B 49/02* | (2006.01) |
| *F04B 49/03* | (2006.01) |

(52) U.S. Cl.
CPC ..... *F04B 43/1136* (2013.01); *F04B 49/022* (2013.01); *F04B 49/03* (2013.01)

(56) References Cited

U.S. PATENT DOCUMENTS

| | | | | |
|---|---|---|---|---|
| 10,309,391 | B2 * | 6/2019 | Matsuda | F04B 43/08 |
| 10,718,324 | B2 * | 7/2020 | Nakano | F04B 45/022 |
| 12,553,429 | B2 * | 2/2026 | Urata | F04B 45/022 |
| 2006/0165541 | A1 * | 7/2006 | Teshima | F04B 43/10 417/472 |
| 2010/0119392 | A1 * | 5/2010 | Masuda | F04B 43/084 417/472 |
| 2011/0318207 | A1 * | 12/2011 | Katsura | F04B 43/086 417/472 |
| 2014/0072465 | A1 * | 3/2014 | Adachi | F04B 45/022 417/472 |
| 2016/0377071 | A1 * | 12/2016 | Fujii | F04B 43/0072 417/472 |
| 2017/0191476 | A1 * | 7/2017 | Matsuda | F04B 53/10 |
| 2017/0218946 | A1 * | 8/2017 | Yamada | F04B 49/06 |
| 2017/0350382 | A1 * | 12/2017 | Nakano | F04B 43/10 |
| 2020/0182234 | A1 * | 6/2020 | Nakano | F04B 49/08 |
| 2022/0236093 | A1 * | 7/2022 | Yin | F04B 9/10 |
| 2022/0341414 | A1 * | 10/2022 | Otono | F04B 49/22 |
| 2024/0044325 | A1 * | 2/2024 | Urata | F04B 45/022 |

FOREIGN PATENT DOCUMENTS

| | | | | | |
|---|---|---|---|---|---|
| JP | H0814163 | A | * | 1/1996 | |
| JP | H10-54368 | A | | 2/1998 | |
| JP | 3519364 | B2 | * | 4/2004 | |
| JP | 2004293502 | A | * | 10/2004 | |
| JP | 5315550 | B2 | * | 10/2013 | F04B 43/113 |
| JP | 5559020 | B2 | * | 7/2014 | |
| JP | 5720888 | B2 | * | 5/2015 | F04B 45/022 |
| JP | 2016037912 | A | * | 3/2016 | |
| JP | 2016109022 | A | * | 6/2016 | |
| JP | 2017-14962 | A | | 1/2017 | |
| JP | 2017014962 | A | * | 1/2017 | |
| JP | 2017219015 | A | * | 12/2017 | |
| JP | 2018025143 | A | * | 2/2018 | |
| JP | 2021042685 | A | * | 3/2021 | F04B 49/22 |
| WO | WO-2010143469 | A1 | * | 12/2010 | F04B 43/113 |

* cited by examiner

BELLOWS PUMP DEVICE

TECHNICAL FIELD

The present invention relates to a bellows pump device.

BACKGROUND ART

As a bellows pump used for feeding a transport fluid such as a chemical solution or a solvent in semiconductor production, chemical industries, or the like, there is a bellows pump which includes: a pair of bellows configured to suck a transport fluid thereinto and discharge the transport fluid therefrom by expanding/contracting independently of each other; and a pair of air cylinders configured to cause the respective bellows to expand/contract, by supplying/discharging pressurized air (see, for example, PATENT LITERATURE 1). The bellows pump described in PATENT LITERATURE 1 controls drive of each air cylinder such that, before one bellows contracts most (ends the discharge), the other bellows is caused to contract from a most expanded state to discharge the transport fluid.

By controlling drive of each air cylinder as described above, at a time when one bellows switches from contraction to expansion (from discharge to suction of the transport fluid), the other bellows has already contracted to discharge the transport fluid. Accordingly, great fall of the discharge pressure of the transport fluid at the above time can be reduced, so that pulsation on the discharge side of the bellows pump can be reduced.

CITATION LIST

Patent Literature

PATENT LITERATURE 1: Japanese Laid-Open Patent Publication No. 2004-293502

SUMMARY OF THE INVENTION

Technical Problem

In the bellows pump, the air pressure of the pressurized air to be supplied to each air cylinder is increased in order to increase the discharge flow rate of the transport fluid. However, if the air pressure is increased, when a bellows switches from expansion to contraction (especially when a bellows stops expansion), a great pressure variation (pressure rise) occurs instantaneously in the bellows, so that an impact pressure called "water hammer" is generated. The generation of such an impact pressure may adversely affect a semiconductor manufacturing process or the like.

The present disclosure has been made in view of such circumstances, and an object of the present disclosure is to suppress an impact pressure generated upon switching from suction to discharge of a transport fluid in a bellows pump device that reduces pulsation on the discharge side thereof.

Solution to Problem (1) A bellows pump device of the present disclosure includes: a first bellows and a second bellows expandable/contractible between a most expanded state and a most contracted state independently of each other and configured to suck a transport fluid thereinto by expansion thereof and discharge the transport fluid therefrom by contraction thereof; a first driving unit configured to drive the first bellows to actively expand and contract; a second driving unit configured to drive the second bellows to actively expand and contract; a first detection unit configured to detect an expanded/contracted state of the first bellows; a second detection unit configured to detect an expanded/contracted state of the second bellows; and a control unit configured to perform operation control of the first driving unit and the second driving unit on the basis of respective detection signals of the first detection unit and the second detection unit such that, after expansion drive of the first bellows is stopped in a first mid-expansion state before the most expanded state, contraction drive of the first bellows is started before the second bellows reaches the most contracted state, and after expansion drive of the second bellows is stopped in a second mid-expansion state before the most expanded state, contraction drive of the second bellows is started before the first bellows reaches the most contracted state.

In the above bellows pump device, the control unit starts the contraction drive of the first bellows (second bellows) before the second bellows (first bellows) reaches the most contracted state. Accordingly, at a time of switching from discharge to suction of the second bellows (first bellows), the first bellows (second bellows) has already discharged the transport fluid, so that fall of the discharge pressure of the transport fluid at the above time of switching can be reduced. As a result, pulsation on the discharge side of the bellows pump device can be reduced.

Moreover, the control unit stops the active expansion drive of the first bellows (second bellows) in the first mid-expansion state (second mid-expansion state) before the most expanded state. Therefore, when the expansion drive of the first bellows (second bellows) stops, even if a pressure rise occurs in the first bellows (second bellows) due to an impact pressure, the pressure rise can be absorbed by the first bellows (second bellows) passively expanding from the first mid-expansion state (second mid-expansion state). Accordingly, an impact pressure generated upon switching from suction to discharge of the transport fluid can be suppressed.

(2) Preferably, the first mid-expansion state is a state where an expansion allowance allowing the first bellows to passively expand due to a pressure rise in the first bellows is ensured, and the second mid-expansion state is a state where an expansion allowance allowing the second bellows to passively expand due to a pressure rise in the second bellows is ensured.

In this case, in the first mid-expansion state (second mid-expansion state), since the expansion allowance allowing the first bellows (second bellows) to passively expand is ensured, a pressure rise in the first bellows (second bellows) can be effectively absorbed by the passive expansion thereof. As a result, the above impact pressure can be further suppressed.

(3) Preferably, the control unit performs the operation control such that a time difference from stopping the expansion drive of the first bellows in the first mid-expansion state to starting the contraction drive of the first bellows is a first time defined below or longer and a time difference from stopping the expansion drive of the second bellows in the second mid-expansion state to starting the contraction drive of the second bellows is a second time defined below or longer, the first time: a time during which the first bellows passively expands due to a pressure rise in the first bellows, and the second time: a time during which the second bellows passively expands due to a pressure rise in the second bellows.

If the first bellows (second bellows) has passively expanded at the time when the contraction drive of the first bellows (second bellows) is started to discharge the transport fluid before the second bellows (first bellows) reaches the most contracted state, the transport fluid in the first bellows (second bellows) cannot be immediately discharged. Thus, there is a possibility that the discharge pressure of the transport fluid cannot be immediately increased and pulsation on the discharge side of the bellows pump device cannot be effectively reduced.

In contrast, with the configuration in (3) above, the time difference from stopping the active expansion drive of the first bellows (second bellows) in the first mid-expansion state (second mid-expansion state) to starting the contraction drive of the first bellows (second bellows) is controlled to be the first time (second time), which is the passive expansion time of the first bellows (second bellows), or longer. Therefore, the passive expansion of the first bellows (second bellows) can be reliably completed within the first time (second time). Accordingly, the contraction drive of the first bellows (second bellows) can be immediately started at the above time. Thus, pulsation on the discharge side of the bellows pump device can be effectively reduced while the above impact pressure is suppressed.

Advantageous Effects of the Invention

According to the present disclosure, it is possible to suppress an impact pressure generated upon switching from suction to discharge of the transport fluid in the bellows pump device that reduces pulsation on the discharge side thereof.

DETAILED DESCRIPTION

Next, a embodiment of the present disclosure will be described with reference to the accompanying drawings.

Entire Configuration

Figure 1:
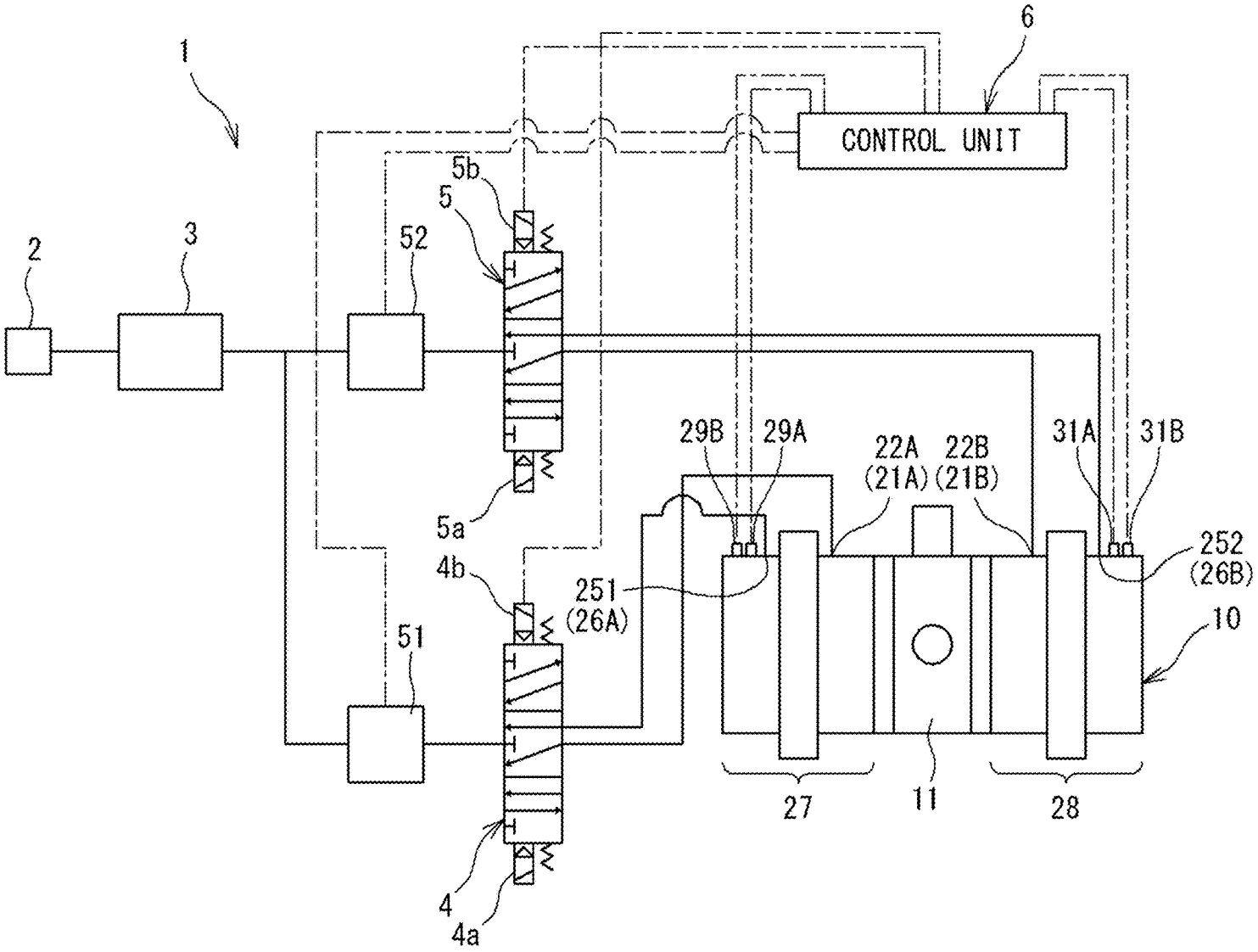
FIG. 1 is a schematic configuration diagram of a bellows pump device according to an embodiment of the present disclosure.

FIG. 1 is a schematic configuration diagram of a bellows pump device according to an embodiment of the present disclosure. A bellows pump device 1 of the present embodiment is used, for example, in a semiconductor production apparatus when a transport fluid such as a chemical solution or a solvent is supplied in a certain amount. The bellows pump device 1 includes an air supply device (fluid supply device) 2, a mechanical regulator 3, a first solenoid valve 4, a second solenoid valve 5, a control unit 6, a bellows pump 10, a first electropneumatic regulator (first fluid pressure adjustment unit) 51, and a second electropneumatic regulator (second fluid pressure adjustment unit) 52.

The air supply device 2 is composed of, for example, an air compressor and generates pressurized air (pressurized fluid) to be supplied to the bellows pump 10. The mechanical regulator 3 manually adjusts the air pressure (fluid pressure) of the pressurized air generated by the air supply device 2. The first electropneumatic regulator 51 and the second electropneumatic regulator 52 will be described later.

Figure 2:
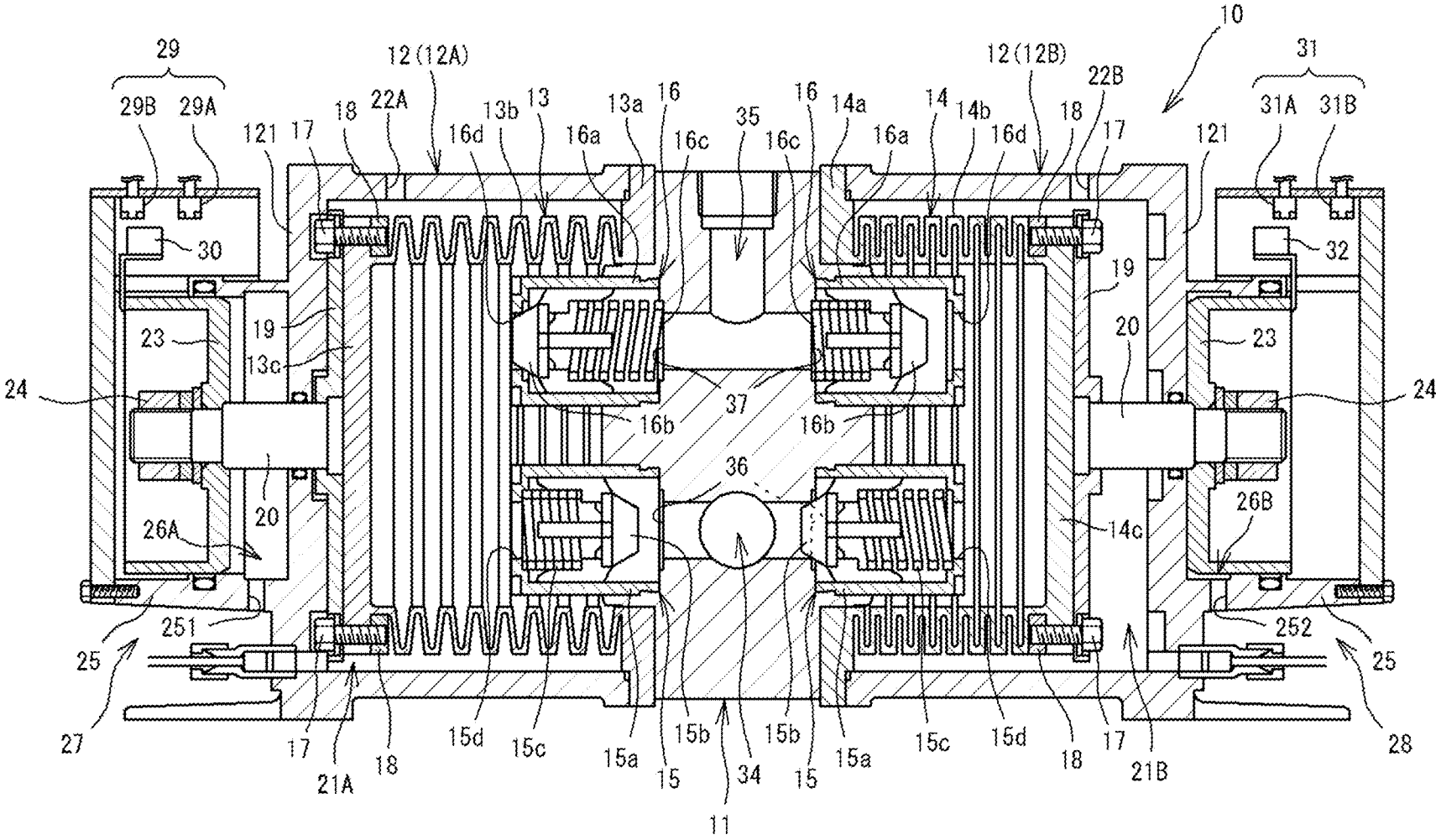
FIG. 2 is a cross-sectional view of a bellows pump.

FIG. 2 is a cross-sectional view of the bellows pump 10. The bellows pump 10 of the present embodiment includes: a pump head 11 which is placed at a center portion; a pair of pump cases 12 which are mounted on both sides of the pump head 11 in a right-left direction; a first bellows 13 and a second bellows 14 which are a pair of bellows mounted on side surfaces of the pump head 11 in the right-left direction and within the respective pump cases 12; and a total of four check valves 15 and check valves 16 which are mounted on the side surfaces of the pump head 11 in the right-left direction and within the respective first and second bellows 13 and 14.

Bellows

The first bellows 13 and the second bellows 14 are each formed in a bottomed cylindrical shape from a fluorine resin such as polytetrafluoroethylene (PTFE) or a tetrafluoroethylene-perfluoro alkyl vinyl ether copolymer (PFA). A flange portion 13*a* and a flange portion 14*a* are integrally formed at open-side end portions of the first and second bellows 13 and 14 and are hermetically pressed and fixed to the side surfaces of the pump head 11.

A peripheral wall 13*b* of the first bellows 13 and a peripheral wall 14*b* of the second bellows 14 are each formed in an accordion shape, and are configured to be expandable/contractible independently of each other in the right-left direction. A thick portion 13*c* which is formed so as to be thicker than the peripheral wall 13*b* is integrally formed at a closed-side end portion of the first bellows 13. Similarly, a thick portion 14*c* which is formed so as to be thicker than the peripheral wall 14*b* is integrally formed at a closed-side end portion of the second bellows 14. The respective thicknesses of the thick portions 13*c* and 14*c* are set such that the thick portions 13*c* and 14*c* do not deform elastically even if a pressure rise due to an impact pressure occurs in the first and second bellows 13 and 14.

A working plate 19 is in close contact with and fixed to each of the outer surfaces of the thick portions 13*c* and 14*c* of the first and second bellows 13 and 14 by bolts 17 and nuts 18. Accordingly, each of the first and second bellows 13 and 14 is expandable/contractible between a most expanded state where the outer surface of the working plate 19 is in contact with the inner surface of a bottom wall portion 121 of the pump case 12 having a bottomed cylindrical shape and a most contracted state where the inner surface of a piston body 23 described later is in contact with the outer surface of the bottom wall portion 121.

Pump Cases

An opening peripheral portion of the pump case 12 (hereinafter also referred to as "first pump case 12A") is hermetically pressed and fixed to the flange portion 13*a* of the first bellows 13. Accordingly, a first discharge-side air chamber (first discharge-side fluid chamber) 21A is formed on the outer side of the first bellows 13 within the first pump case 12A such that a hermetic state thereof is maintained.

A first suction/discharge port 22A is provided in the first pump case 12A and connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first discharge-side air chamber 21A, the first bellows 13 contracts.

An opening peripheral portion of the pump case 12 (hereinafter also referred to as "second pump case 12B") is hermetically pressed and fixed to the flange portion 14*a* of the second bellows 14. Accordingly, a second discharge-side air chamber (second discharge-side fluid chamber) 21B is formed on the outer side of the second bellows 14 within the second pump case 12B such that a hermetic state thereof is maintained.

A second suction/discharge port 22B is provided in the second pump case 12B and connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second discharge-side air chamber 21B, the second bellows 14 contracts.

A rod-shaped connection member 20 penetrates the bottom wall portion 121 of each pump case 12A, 12B and is supported so as to be slidable in the right-left direction relative to the bottom wall portion 121. The piston body 23 is fixed to an outer end portion of the connection member 20 by a nut 24. The piston body 23 is supported so as to be slidable in the right-left direction relative to an inner circumferential surface of a cylindrical cylinder body 25, which is integrally provided on the outer side of the bottom wall portion 121, with a hermetic state maintained.

Accordingly, on the first pump case 12A side, a space surrounded by the bottom wall portion 121, the cylinder body 25, and the piston body 23 is formed as a first suction-side air chamber (first suction-side fluid chamber) 26A of which a hermetic state is maintained. In addition, on the second pump case 12B side, a space surrounded by the bottom wall portion 121, the cylinder body 25, and the piston body 23 is formed as a second suction-side air chamber (second suction-side fluid chamber) 26B of which a hermetic state is maintained.

In the cylinder body 25 on the first pump case 12A side, a suction/discharge port 251 is formed so as to communicate with the first suction-side air chamber 26A. The suction/discharge port 251 is connected to the air supply device 2 via the first solenoid valve 4, the first electropneumatic regulator 51, and the mechanical regulator 3 (see FIG. 1). Accordingly, when the pressurized air is supplied from the air supply device 2 to the interior of the first suction-side air chamber 26A via the suction/discharge port 251, the first bellows 13 expands.

In the cylinder body 25 on the second pump case 12B side, a suction/discharge port 252 is formed so as to communicate with the second suction-side air chamber 26B. The suction/discharge port 252 is connected to the air supply device 2 via the second solenoid valve 5, the second electropneumatic regulator 52, and the mechanical regulator 3 (see FIG. 1). Accordingly, when the pressurized air is supplied from the air supply device 2 to the interior of the second suction-side air chamber 26B via the suction/discharge port 252, the second bellows 14 expands.

Because of the above configuration, the first pump case 12A, in which the first discharge-side air chamber 21A is formed, and the piston body 23 and the cylinder body 25 which form the first suction-side air chamber 26A, form a first driving unit 27 which drives the first bellows 13 to actively expand and contract.

In addition, the second pump case 12B, in which the second discharge-side air chamber 21B is formed, and the piston body 23 and the cylinder body 25 which form the second suction-side air chamber 26B, form a second driving unit 28 which drives the second bellows 14 to actively expand and contract.

Detection Units

A pair of a proximity sensor 29A and a proximity sensor 29B are mounted on the cylinder body 25 of the first driving unit 27. A detection plate 30 to be detected by each of the proximity sensors 29A and 29B is mounted on the piston body 23 of the first driving unit 27. The detection plate 30 reciprocates together with the piston body 23, whereby the detection plate 30 alternately comes close to the proximity sensors 29A and 29B.

The proximity sensor 29A is placed at a position where the proximity sensor 29A detects the detection plate 30 when the first bellows 13 is in a first mid-contraction state (described later) before the most contracted state. The proximity sensor 29B is placed at a position where the proximity sensor 29B detects the detection plate 30 when the first bellows 13 is in a first mid-expansion state (described later) before the most expanded state. When the respective proximity sensors 29A and 29B detect the detection plate 30, the proximity sensors 29A and 29B output detection signals thereof to the control unit 6. The pair of proximity sensors 29A and 29B function as a first detection unit which detects an expanded/contracted state of the first bellows 13.

A pair of a proximity sensor 31A and a proximity sensor 31B are mounted on the cylinder body 25 of the second driving unit 28. A detection plate 32 to be detected by each of the proximity sensors 31A and 31B is mounted on the piston body 23 of the second driving unit 28. The detection plate 32 reciprocates together with the piston body 23, whereby the detection plate 32 alternately comes close to the proximity sensors 31A and 31B.

The proximity sensor 31A is placed at a position where the proximity sensor 31A detects the detection plate 32 when the second bellows 14 is in a second mid-contraction state (described later) before the most contracted state. The proximity sensor 31B is placed at a position where the proximity sensor 31B detects the detection plate 32 when the second bellows 14 is in a second mid-expansion state (described later) before the most expanded state. When the respective proximity sensors 31A and 31B detect the detection plate 32, the proximity sensors 31A and 31B output detection signals thereof to the control unit 6. The pair of proximity sensors 31A and 31B function as a second detection unit which detects an expanded/contracted state of the second bellows 14.

Pump Head

The pump head 11 is formed from a fluorine resin such as PTFE or PFA. A suction passage 34 and a discharge passage 35 for the transport fluid are formed within the pump head 11. The suction passage 34 and the discharge passage 35 are opened in an outer peripheral surface of the pump head 11 and are respectively connected to a suction port and a discharge port (both are not shown) provided at the outer peripheral surface.

The suction port is connected to a storage tank for the transport fluid or the like, and the discharge port is connected to a transport destination for the transport fluid. In addition, the suction passage 34 and the discharge passage 35 each branch toward both right and left side surfaces of the pump head 11, and have suction openings 36 and discharge openings 37 which are opened in both right and left side surfaces of the pump head 11. Each suction opening 36 and each discharge opening 37 communicate with the interior of the bellows 13 or 14 via the check valves 15 and 16, respectively.

Check Valves

The check valves 15 and 16 are provided at each suction opening 36 and each discharge opening 37.

The check valve 15 (hereinafter, also referred to as "suction check valve") mounted at each suction opening 36 includes: a valve case 15*a*; a valve body 15*b* which is housed in the valve case 15*a*; and a compression coil spring 15*c* which biases the valve body 15*b* in a valve closing direction.

The valve case 15*a* is formed in a bottomed cylindrical shape. A through hole 15*d* is formed in a bottom wall of the valve case 15*a* so as to communicate with the interior of the bellows 13 or 14. The valve body 15*b* closes the suction opening 36 (performs valve closing) by the biasing force of the compression coil spring 15*c*, and opens the suction opening 36 (performs valve opening) when a back pressure generated by flow of the transport fluid occurring with expansion/contraction of the bellows 13 or 14 acts thereon.

Accordingly, the suction check valve 15 opens, when the bellows 13 or 14 at which the suction check valve 15 is placed expands, to permit suction of the transport fluid in a direction from the suction passage 34 toward the interior of the bellows 13 or 14 (in one direction). In addition, the suction check valve 15 closes, when the bellows 13 or 14 at which the suction check valve 15 is placed contracts, to block backflow of the transport fluid in a direction from the interior of the bellows 13 or 14 toward the suction passage 34 (in another direction).

The check valve 16 (hereinafter, also referred to as "discharge check valve") mounted at each discharge opening 37 includes: a valve case 16*a*; a valve body 16*b* which is housed in the valve case 16*a*; and a compression coil spring 16*c* which biases the valve body 16*b* in a valve closing direction.

The valve case 16*a* is formed in a bottomed cylindrical shape. A through hole 16*d* is formed in a bottom wall of the valve case 16*a* so as to communicate with the interior of the bellows 13 or 14. The valve body 16*b* closes the through hole 16*d* of the valve case 16*a* (performs valve closing) by the biasing force of the compression coil spring 16*c*, and opens the through hole 16*d* of the valve case 16*a* (performs valve opening) when a back pressure generated by flow of the transport fluid occurring with expansion/contraction of the bellows 13 or 14 acts thereon.

Accordingly, the discharge check valve 16 opens, when the bellows 13 or 14 at which the discharge check valve 16 is placed contracts, to permit outflow of the transport fluid in a direction from the interior of the bellows 13 or 14 toward the discharge passage 35 (in one direction). In addition, the discharge check valve 16 closes, when the bellows 13 or 14 at which the discharge check valve 16 is placed expands, to block backflow of the transport fluid in a direction from the discharge passage 35 toward the interior of the bellows 13 or 14 (in another direction).

Operation of Bellows Pump

Figure 3:
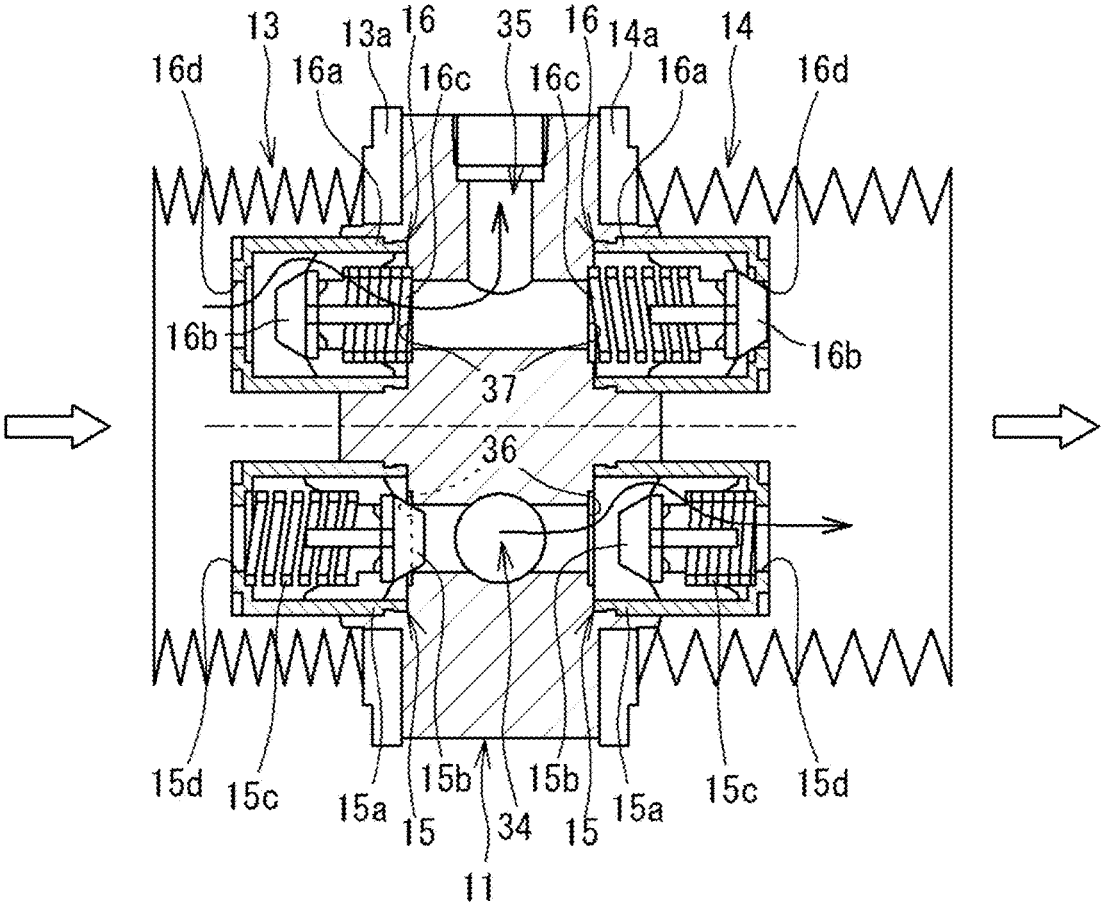
FIG. 3 is an explanatory diagram showing operation of the bellows pump.
Figure 4:
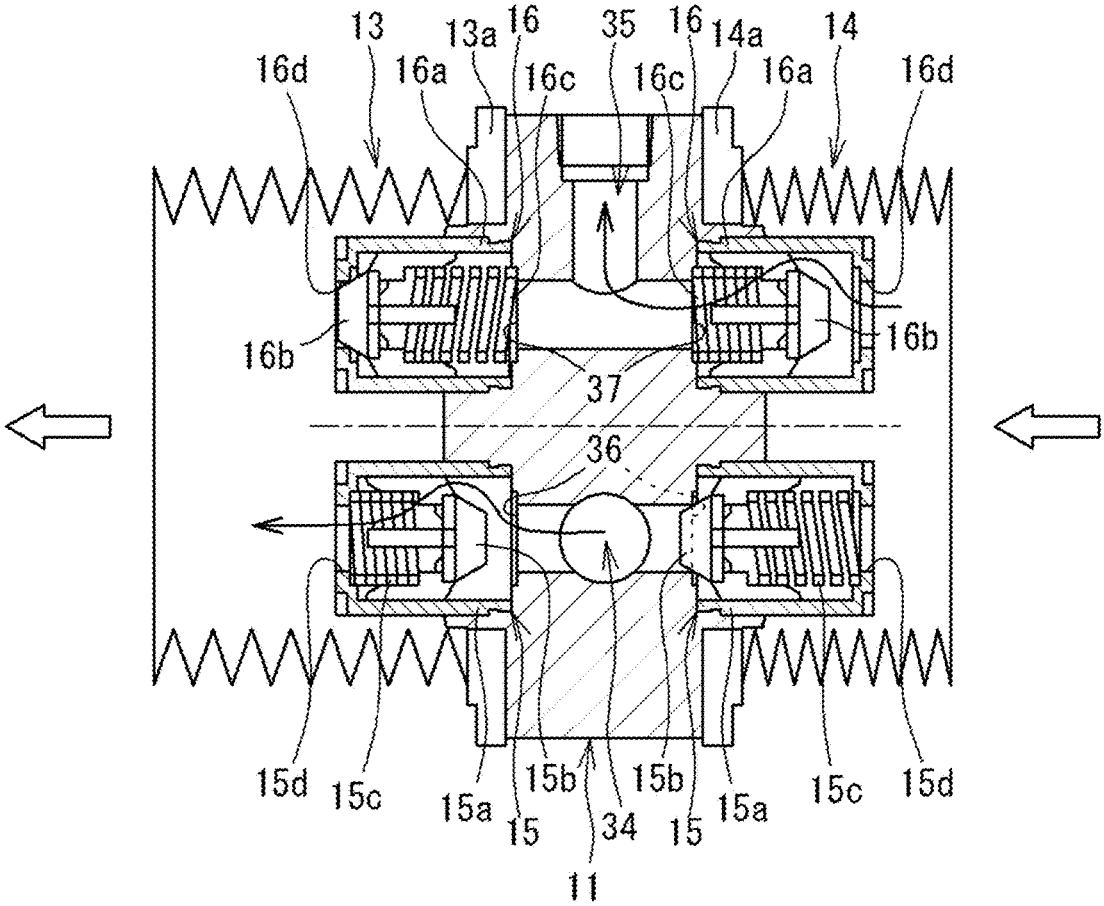
FIG. 4 is an explanatory diagram showing operation of the bellows pump.

Next, operation of the bellows pump 10 of the present embodiment will be described with reference to FIG. 3 and FIG. 4. In FIG. 3 and FIG. 4, the configurations of the first and second bellows 13 and 14 are shown in a simplified manner. As shown in FIG. 3, when the first bellows 13 contracts and the second bellows 14 expands, the respective valve bodies 15*b* and 16*b* of the suction check valve 15 and the discharge check valve 16 that are mounted on the left side of the pump head 11 in the drawing receive pressure from the transport fluid within the first bellows 13 and move to the right sides of the respective valve cases 15*a* and 16*a* in the drawing. Accordingly, the suction check valve 15 closes, and the discharge check valve 16 opens, so that the transport fluid within the first bellows 13 is discharged through the discharge passage 35 to the outside of the pump.

Meanwhile, the valve body 15*b* of the suction check valve 15 mounted on the right side of the pump head 11 in the drawing moves to the right side of the valve case 15*a* in the drawing due to a suction action by the second bellows 14. The valve body 16*b* of the discharge check valve 16 mounted on the right side of the pump head 11 in the drawing moves to the right side of the valve case 16*a* in the drawing due to a suction action by the second bellows 14 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the second bellows 14.

Next, as shown in FIG. 4, when the first bellows 13 expands and the second bellows 14 contracts, the respective valve bodies 15*b* and 16*b* of the suction check valve 15 and the discharge check valve 16 that are mounted on the right side of the pump head 11 in the drawing receive pressure from the transport fluid within the second bellows 14 and move to the left sides of the respective valve cases 15*a* and 16*a* in the drawing. Accordingly, the suction check valve 15 closes, and the discharge check valve 16 opens, so that the transport fluid within the second bellows 14 is discharged through the discharge passage 35 to the outside of the pump.

Meanwhile, the valve body 15*b* of the suction check valve 15 mounted on the left side of the pump head 11 in the drawing moves to the left side of the valve case 15*a* in the drawing due to a suction action by the first bellows 13. The valve body 16*b* of the discharge check valve 16 mounted on the left side of the pump head 11 in the drawing moves to the left side of the valve case 16*a* in the drawing due to a suction action by the first bellows 13 and a pressing action by the transport fluid discharged from the first bellows 13 to the discharge passage 35. Accordingly, the suction check valve 15 opens, and the discharge check valve 16 closes, so that the transport fluid is sucked from the suction passage 34 into the first bellows 13.

By repeatedly performing the above operation, the left and right bellows 13 and 14 can alternately suck and discharge the transport fluid.

Solenoid Valves

In FIG. 1, the first solenoid valve 4 is composed of, for example, a three-position solenoid switching valve including a pair of a solenoid 4*a* and a solenoid 4*b*. Each of the solenoids 4*a* and 4*b* is configured to be magnetized on the basis of a command signal received from the control unit 6. Accordingly, the first solenoid valve 4 is switched and controlled by the control unit 6. The first solenoid valve 4 switches between supply/discharge of the pressurized air to/from the first discharge-side air chamber 21A and supply/discharge of the pressurized air to/from the first suction-side air chamber 26A in the first driving unit 27.

Specifically, when the solenoid 4*a* is magnetized, the first solenoid valve 4 switches to a state where the pressurized air is supplied to the first discharge-side air chamber 21A and the pressurized air within the first suction-side air chamber 26A is discharged. In addition, when the solenoid 4*b* is magnetized, the first solenoid valve 4 switches to a state where the pressurized air within the first discharge-side air chamber 21A is discharged and the pressurized air is supplied to the first suction-side air chamber 26A.

The second solenoid valve 5 is composed of, for example, a three-position solenoid switching valve including a pair of a solenoid 5*a* and a solenoid 5*b*. Each of the solenoids 5*a* and 5*b* is configured to be magnetized upon reception of a command signal from the control unit 6. Accordingly, the second solenoid valve 5 is switched and controlled by the control unit 6. The second solenoid valve 5 switches between supply/discharge of the pressurized air to/from the second discharge-side air chamber 21B and supply/discharge of the pressurized air to/from the second suction-side air chamber 26B in the second driving unit 28.

Specifically, when the solenoid 5*a* is magnetized, the second solenoid valve 5 switches to a state where the pressurized air is supplied to the second discharge-side air chamber 21B and the pressurized air within the second suction-side air chamber 26B is discharged. In addition, when the solenoid 5*b* is magnetized, the second solenoid valve 5 switches to a state where the pressurized air within the second discharge-side air chamber 21B is discharged and the pressurized air is supplied to the second suction-side air chamber 26B.

Although each of the first and second solenoid valves 4 and 5 of the present embodiment is composed of the three-position solenoid switching valve, each of the first and second solenoid valves 4 and 5 may be a two-position solenoid switching valve which does not have a neutral position.

Electropneumatic Regulators

The first electropneumatic regulator 51 is placed between the mechanical regulator 3 and the first solenoid valve 4. The first electropneumatic regulator 51 adjusts the air pressure (first fluid pressure) of the pressurized air to be supplied to the first suction-side air chamber 26A of the first driving unit 27 and the air pressure of the pressurized air to be supplied to the first discharge-side air chamber 21A of the first driving unit 27.

The second electropneumatic regulator 52 is placed between the mechanical regulator 3 and the second solenoid valve 5. The second electropneumatic regulator 52 adjusts the air pressure (second fluid pressure) of the pressurized air to be supplied to the second suction-side air chamber 26B of the second driving unit 28 and the air pressure of the pressurized air to be supplied to the second discharge-side air chamber 21B of the second driving unit 28.

In the present embodiment, the electropneumatic regulators 51 and 52, which directly adjust the air pressure, are used as the first and second fluid pressure adjustment units, but the air pressure may be adjusted indirectly using an air flow rate adjusting valve which adjusts an air flow rate, or a device that adjusts the pressure or flow rate of a gas other than air (for example, nitrogen), a liquid, or the like may be used.

Control Unit

In FIG. 1 and FIG. 2, the control unit 6 is configured to include a computer having a CPU or the like. Each function of the control unit 6 is performed by the CPU executing a control program stored in a storage device of the computer. The control unit 6 performs operation control of the first driving unit 27 and the second driving unit 28 by switching the first solenoid valve 4 and the second solenoid valve 5 on the basis of the respective detection signals of a first detection unit 29 and a second detection unit 31.

In the above operation control, on the basis of the respective detection signals of the first detection unit 29 and the second detection unit 31, the control unit 6 controls the respective operations of the first driving unit 27 and the second driving unit 28 such that, after the expansion drive of the first bellows 13 is stopped in the first mid-expansion state before the most expanded state, the contraction drive of the first bellows 13 is started when the second bellows 14 reaches the second mid-contraction state before the most contracted state.

The "first mid-expansion state" of the first bellows 13 means that the expansion progress position of the first bellows 13 is a position that is closer to the most expanded state than to the most contracted state and at which an expansion allowance allowing the first bellows 13 to passively expand due to a pressure rise in the first bellows 13 is ensured. More specifically, the "first mid-expansion state" means that the expansion progress position of the first bellows 13 is a position at which the first bellows 13 expands within a range of not less than 50% and not greater than 95% of an expansion length from the most contracted state to the most expanded state.

The "second mid-contraction state" of the second bellows 14 means that the contraction progress position of the second bellows 14 is a position that is closer to the most contracted state than to the most expanded state. More specifically, the "second mid-contraction state" means that the contraction progress position of the second bellows 14 is a position at which the second bellows 14 contracts within a range of greater than 50% and not greater than 95% of a contraction length from the most expanded state to the most contracted state.

In the above operation control, on the basis of the respective detection signals of the first detection unit 29 and the second detection unit 31, the control unit 6 controls the respective operations of the first driving unit 27 and the second driving unit 28 such that, after the expansion drive of the second bellows 14 is stopped in the second mid-expansion state before the most expanded state, the contraction drive of the second bellows 14 is started when the first bellows 13 reaches the first mid-contraction state before the most contracted state.

The "second mid-expansion state" of the second bellows 14 means that the expansion progress position of the second bellows 14 is a position that is closer to the most expanded state than to the most contracted state and at which an expansion allowance allowing the second bellows 14 to passively expand due to a pressure rise in the second bellows 14 is ensured. More specifically, the "second mid-expansion state" means that the expansion progress position of the second bellows 14 is a position at which the second bellows 14 expands within a range of not less than 50% and not greater than 95% of an expansion length from the most contracted state to the most expanded state.

The "first mid-contraction state" of the first bellows 13 means that the contraction progress position of the first bellows 13 is a position that is closer to the most contracted state than to the most expanded state. More specifically, the "first mid-contraction state" means that the contraction progress position of the first bellows 13 is a position at which the first bellows 13 contracts within a range of greater than 50% and not greater than 95% of a contraction length from the most expanded state to the most contracted state.

The control unit 6 performs the above operation control such that the time difference from stopping the expansion drive of the first bellows 13 in the first mid-expansion state to starting the contraction drive of the first bellows 13 is a first time T10 or longer. The "first time" is a time during which the first bellows 13 passively expands due to a pressure rise in the first bellows 13 (time from the start of expansion to the end of expansion). The control unit 6 of the present embodiment performs the above operation control such that the above time difference of the first bellows 13 is the first time T10.

The first time T10 may be set to a time other than the above. For example, the first time T10 may be set to a time during which the first bellows 13 passively expands from the first mid-expansion state to the most expanded state due to a pressure rise in the first bellows 13.

The control unit 6 performs the above operation control such that the time difference from stopping the expansion drive of the second bellows 14 in the second mid-expansion state to starting the contraction drive of the second bellows 14 is a second time T20 or longer. The "second time" is a time during which the second bellows 14 passively expands due to a pressure rise in the second bellows 14 (time from the start of expansion to the end of expansion). The control unit 6 of the present embodiment performs the above operation control such that the above time difference of the second bellows 14 is the second time T20.

The second time T20 may be set to a time other than the above. For example, the second time T20 may be set to a time during which the second bellows 14 passively expands from the second mid-expansion state to the most expanded state due to a pressure rise in the second bellows 14.

Operation Control

Figure 5:
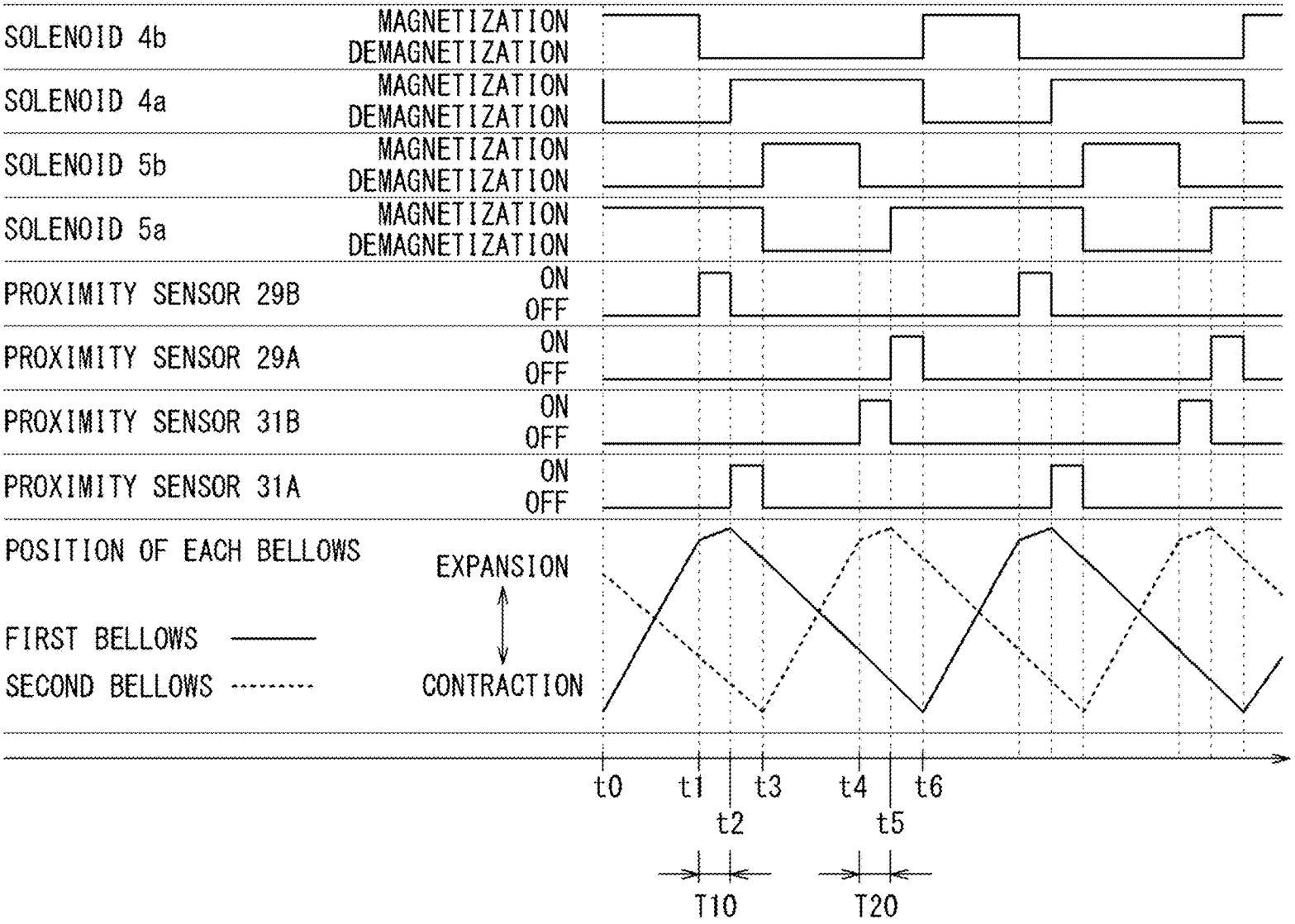
FIG. 5 is a time chart showing an example of operation control performed by a control unit.

FIG. 5 is a time chart showing an example of the operation control performed by the control unit 6. Hereinafter, the operation control performed by the control unit 6 will be described with reference to FIG. 1 and FIG. 5. Here, the description will be given from time t0 at which the first bellows 13 is in the most contracted state and the second bellows 14 is in the middle of contraction operation (discharge).

At time to, the control unit 6 demagnetizes the solenoid 4*a* of the first solenoid valve 4 and magnetizes the solenoid 4*b* of the first solenoid valve 4. At time to, the solenoid 5*a* of the second solenoid valve 5 is magnetized, and the solenoid 5*b* of the second solenoid valve 5 is demagnetized. When the solenoid 4*b* of the first solenoid valve 4 is magnetized, the pressurized air generated by the air supply device 2 is supplied to the first suction-side air chamber 26A of the first driving unit 27 via the mechanical regulator 3, the first electropneumatic regulator 51, and the first solenoid valve 4. Accordingly, the first driving unit 27 starts active expansion drive of the first bellows 13 that is in the most contracted state.

At this time, the control unit 6 controls the speed of expansion of the first bellows 13 by the first driving unit 27 and makes time t1 earlier or later such that the time difference (t2–t1) from time t1 to time t2 which will be described later is the first time T10 (e.g., 30 msec to 60 msec). Specifically, the control unit 6 outputs a control command to the first electropneumatic regulator 51 and causes the first electropneumatic regulator 51 to adjust the air pressure of the pressurized air to be supplied to the first suction-side air chamber 26A, while driving the first bellows 13 to actively expand from time to t0 time t1. Accordingly, the speed of expansion of the first bellows 13 by the first driving unit 27 is controlled.

Next, at time t1 at which the proximity sensor 29B detects the first mid-expansion state of the first bellows 13 (is turned ON), the control unit 6 demagnetizes the solenoid 4*b* of the first solenoid valve 4. Accordingly, the first driving unit 27 stops the active expansion drive of the first bellows 13 in the first mid-expansion state. When the active expansion drive of the first bellows 13 stops, the transport fluid is no longer sucked into the first bellows 13 and the flow of the transport fluid changes, thereby generating an impact pressure. This impact pressure causes a pressure rise in the first bellows 13.

Due to the pressure rise in the first bellows 13, the first bellows 13 passively expands from the first mid-expansion state within the above first time T10. Here, the first bellows 13 passively expands to the most expanded state. By the first bellows 13 passively expanding as described above, the pressure rise in the first bellows 13 can be absorbed before the first time T10 elapses.

Next, at time t2 at which the proximity sensor 31A detects the second mid-contraction state of the second bellows 14 (is turned ON), the control unit 6 magnetizes the solenoid 4*a* of the first solenoid valve 4. Thus, the pressurized air generated by the air supply device 2 is supplied to the first discharge-side air chamber 21A of the first driving unit 27 via the mechanical regulator 3, the first electropneumatic regulator 51, and the first solenoid valve 4. Accordingly, the first driving unit 27 starts active contraction drive of the first bellows 13, which is in the most expanded state, before the second bellows 14 reaches the most contracted state. Accordingly, the first bellows 13 and the second bellows 14 are both in a state of being driven to contract.

Next, at time t3 at which a predetermined calculation time elapses from time t2 at which the proximity sensor 31A is turned ON, the control unit 6 determines that the second bellows 14 has reached the most contracted state. Then, the control unit 6 demagnetizes the solenoid 5*a* of the second solenoid valve 5 and magnetizes the solenoid 5*b* of the second solenoid valve 5. When the solenoid 5*b* of the second solenoid valve 5 is magnetized, the pressurized air generated by the air supply device 2 is supplied to the second suction-side air chamber 26B of the second driving unit 28 via the mechanical regulator 3, the second electropneumatic regulator 52, and the second solenoid valve 5. Accordingly, the second driving unit 28 starts active expansion drive of the second bellows 14 that is in the most contracted state.

At this time, the control unit 6 controls the speed of expansion of the second bellows 14 by the second driving unit 28 and makes time t4 earlier or later such that the time difference (t5–t4) from time t4 to time t5 which will be described later is the second time T20 (e.g., 30 msec to 60 msec). Specifically, the control unit 6 outputs a control command to the second electropneumatic regulator 52 and causes the second electropneumatic regulator 52 to adjust the air pressure of the pressurized air to be supplied to the second suction-side air chamber 26B, while driving the second bellows 14 to actively expand from time t3 to time t4. Accordingly, the speed of expansion of the second bellows 14 by the second driving unit 28 is controlled.

Next, at time t4 at which the proximity sensor 31B detects the second mid-expansion state of the second bellows 14 (is turned ON), the control unit 6 demagnetizes the solenoid 5*b* of the second solenoid valve 5. Accordingly, the second driving unit 28 stops the active expansion drive of the second bellows 14 in the second mid-expansion state. When the active expansion drive of the second bellows 14 stops, the transport fluid is no longer sucked into the second bellows 14 and the flow of the transport fluid changes, thereby generating an impact pressure. This impact pressure causes a pressure rise in the second bellows 14.

Due to the pressure rise in the second bellows 14, the second bellows 14 passively expands from the second mid-expansion state within the above second time T20. Here, the second bellows 14 expands to the most expanded state. By the second bellows 14 passively expanding as described above, the pressure rise in the second bellows 14 can be absorbed before the second time T20 elapses.

Next, at time t5 at which the proximity sensor 29A detects the first mid-contraction state of the first bellows 13 (is turned ON), the control unit 6 magnetizes the solenoid 5*a* of the second solenoid valve 5. Thus, the pressurized air generated by the air supply device 2 is supplied to the second discharge-side air chamber 21B of the second driving unit 28 via the mechanical regulator 3, the second electropneumatic regulator 52, and the second solenoid valve 5. Accordingly, the second driving unit 28 starts active contraction drive of the second bellows 14, which is in the most expanded state, before the first bellows 13 reaches the most contracted state. Accordingly, the first bellows 13 and the second bellows 14 are both in a state of being driven to contract.

Next, at time t6 at which a predetermined calculation time elapses from time t5 at which the proximity sensor 29A is turned ON, the control unit 6 determines that the first bellows 13 has reached the most contracted state. Then, the control unit 6 demagnetizes the solenoid 4*a* of the first solenoid valve 4 and magnetizes the solenoid 4*b* of the first solenoid valve 4. When the solenoid 4*b* is magnetized, the first driving unit 27 starts active expansion drive of the first bellows 13, which is in the most contracted state, as described above.

After that, the control unit 6 repeatedly performs the control performed at each of the above times t0 to t6. Accordingly, the bellows pump 10 is controlled such that, while the pressure rise in the first bellows 13 (second bellows 14) due to the impact pressure is absorbed, the contraction drive of the first bellows 13 (second bellows 14) is started before the second bellows 14 (first bellows 13) reaches the most contracted state.

Advantageous Effects of Present Embodiment

As described above, in the bellows pump device 1 of the present embodiment, the control unit 6 starts the contraction drive of the first bellows 13 (second bellows 14) when the second bellows 14 (first bellows 13) reaches the second mid-contraction state (first mid-contraction state) before the most contracted state. Accordingly, at a time of switching from discharge to suction of the second bellows 14 (first bellows 13), the first bellows 13 (second bellows 14) has already discharged the transport fluid, so that fall of the discharge pressure of the transport fluid at the above time of switching can be reduced. As a result, pulsation on the discharge side of the bellows pump 10 can be reduced.

Moreover, the control unit 6 stops the active expansion drive of the first bellows 13 (second bellows 14) in the first mid-expansion state (second mid-expansion state) before the most expanded state. Therefore, when the expansion drive of the first bellows 13 (second bellows 14) stops, even if a pressure rise occurs in the first bellows 13 (second bellows 14) due to an impact pressure, the pressure rise can be absorbed by the first bellows 13 (second bellows 14) passively expanding from the first mid-expansion state (second mid-expansion state). Accordingly, an impact pressure generated upon switching from suction to discharge of the transport fluid can be suppressed.

Moreover, in the first mid-expansion state (second mid-expansion state), since the expansion allowance allowing the first bellows 13 (second bellows 14) to passively expand is ensured, a pressure rise in the first bellows 13 (second bellows 14) can be effectively absorbed by the passive expansion thereof. As a result, the above impact pressure can be further suppressed.

Moreover, the time difference from stopping the active expansion drive of the first bellows 13 (second bellows 14) in the first mid-expansion state (second mid-expansion state) to starting the contraction drive of the first bellows 13 (second bellows 14) is controlled to be the first time T10 (second time T20) which is the passive expansion time of the first bellows 13 (second bellows 14). Therefore, the passive expansion of the first bellows 13 (second bellows 14) can be reliably completed within the first time T10 (second time T20). Accordingly, when the second bellows 14 (first bellows 13) reaches the second mid-contraction state (first mid-contraction state), the contraction drive of the first bellows 13 (second bellows 14) can be immediately started. Thus, pulsation on the discharge side of the bellows pump 10 can be effectively reduced while the above impact pressure is suppressed.

Others

The first detection unit 29 and the second detection unit 31 of the above embodiment detect the mid-expansion states and the mid-contraction states of the bellows 13 and 14, but may detect other expanded/contracted states thereof. In addition, the first detection unit 29 and the second detection unit 31 are not limited to the proximity sensors 29A, 29B, 31A, and 31B of the above embodiment. For example, the first detection unit 29 and the second detection unit 31 may each be composed of a displacement sensor using a laser beam or the like. The first driving unit 27 and the second driving unit 28 in the present embodiment are driven by the pressurized air, but may be driven by other fluids.

The embodiment disclosed herein is merely illustrative and not restrictive in all aspects. The scope of the present invention is defined by the scope of the claims rather than the meaning described above, and is intended to include meaning equivalent to the scope of the claims and all modifications within the scope.

REFERENCE SIGNS LIST

1 bellows pump device
6 control unit
13 first bellows
14 second bellows
27 first driving unit
28 second driving unit
29 first detection unit
31 second detection unit T10 first time
T20 second time

The invention claimed is:

1. A bellows pump device comprising:

a first bellows expandable and contractible between a most expanded state and a most contracted state and configured to suck a transport fluid thereinto by expansion thereof and discharge the transport fluid therefrom by contraction thereof;

a second bellows expandable and contractible between a most expanded state and a most contracted state independently of the first bellows and configured to suck a transport fluid thereinto by expansion thereof and discharge the transport fluid therefrom by contraction thereof;

a first driving unit configured to drive the first bellows to actively expand and contract;

a second driving unit configured to drive the second bellows to actively expand and contract;

a first detection unit configured to detect an expanded or contracted state of the first bellows;

a second detection unit configured to detect an expanded or contracted state of the second bellows; and a control unit configured to perform operation control of the first driving unit and the second driving unit on a basis of respective detection signals of the first detection unit and the second detection unit such that, after expansion drive of the first bellows is stopped in a first mid-expansion state before the most expanded state, contraction drive of the first bellows is started before the second bellows reaches the most contracted state, and after expansion drive of the second bellows is stopped in a second mid-expansion state before the most expanded state, contraction drive of the second bellows is started before the first bellows reaches the most contracted state.

2. The bellows pump device according to claim 1, wherein the first mid-expansion state is a state where an expansion allowance allowing the first bellows to passively expand due to a pressure rise in the first bellows is ensured, and the second mid-expansion state is a state where an expansion allowance allowing the second bellows to passively expand due to a pressure rise in the second bellows is ensured.

3. The bellows pump device according to claim 2, wherein the control unit performs the operation control such that a time difference from stopping the expansion drive of the first bellows in the first mid-expansion state to starting the contraction drive of the first bellows is a first time defined below or longer and a time difference from stopping the expansion drive of the second bellows in the second mid-expansion state to starting the contraction drive of the second bellows is a second time defined below or longer, the first time: a time during which the first bellows passively expands due to the pressure rise in the first bellows, and the second time: a time during which the second bellows passively expands due to the pressure rise in the second bellows.

* * * * *